US010773152B2

(12) United States Patent
Su et al.

(10) Patent No.: US 10,773,152 B2
(45) Date of Patent: Sep. 15, 2020

(54) INTELLIGENT MAGIC CUBE, AND SENSING SHAFT CENTER STRUCTURE AND TIMING METHOD USED THEREBY

(71) Applicant: FS GIIKER TECHNOLOGY CO., LTD., Foshan, Guangdong (CN)

(72) Inventors: Ziming Su, Foshan (CN); Juncheng Zhou, Foshan (CN); Changping Li, Foshan (CN)

(73) Assignee: FS GIIKER TECHNOLOGY CO., LTD., Foshan, Guangdong (CN)

( * ) Notice: Subject to any disclaimer, the term of this patent is extended or adjusted under 35 U.S.C. 154(b) by 0 days.

(21) Appl. No.: 16/272,832

(22) Filed: Feb. 11, 2019

(65) Prior Publication Data

US 2019/0184275 A1 Jun. 20, 2019

Related U.S. Application Data

(63) Continuation of application No. PCT/CN2016/104810, filed on Nov. 7, 2016.

(30) Foreign Application Priority Data

Aug. 12, 2016 (CN) ..... 2016 1 0664325

(51) Int. Cl.
*A63F 9/08* (2006.01)
*A63F 9/24* (2006.01)

(52) U.S. Cl.
CPC ..... *A63F 9/0838* (2013.01); *A63F 9/08* (2013.01); *A63F 9/24* (2013.01); *A63F 2009/2447* (2013.01); *A63F 2009/2485* (2013.01)

(58) Field of Classification Search
CPC .... A63F 9/0838; A63F 9/0826; A63F 9/0842; A63F 9/24; A63F 2009/2485; A63F 2009/2447; A63F 2009/2442; A63F 9/08
See application file for complete search history.

(56) References Cited

U.S. PATENT DOCUMENTS 4,817,952 A * 4/1989 Biro ..... A63F 9/0826
8,342,527 B2 1/2013 Wu
(Continued)

FOREIGN PATENT DOCUMENTS

CN 101690847 A 4/2010
CN 102068814 5/2011
(Continued)

OTHER PUBLICATIONS

International Search Report issued for International Patent Application No. PCT/CN2016/104810, dated May 15, 2017, 6 pages including English translation.
(Continued)

*Primary Examiner* — Raleigh W Chiu
(74) *Attorney, Agent, or Firm* — Hamre, Schumann, Mueller & Larson, P.C.

(57) ABSTRACT

An intelligent magic cube, and a sensing shaft center structure and a timing method used thereby. The sensing shaft center structure comprises a main body; the main body comprises a core (1) having an internal cavity, and several tubular shafts (2) communicated with the core (1). An internal central control module (3) is provided inside the cavity, and comprises a state obtaining unit. Each tubular shaft (2) is provided with a state signal sending set (4). The state signal sending set (4) comprises a signal selector and multiple signal exciters. The signal selector may be paired with any signal exciter, and generate a corresponding state signal. The state obtaining unit is configured to be able to receive the state signal sent from the state signal sending set (4).

8 Claims, 11 Drawing Sheets

(56) References Cited

U.S. PATENT DOCUMENTS

| | | | | |
|---|---|---|---|---|
| 2008/0237981 | A1* | 10/2008 | Gilles | A63F 9/0842 |
| 2012/0184341 | A1* | 7/2012 | Dai | A63F 9/0842 463/9 |
| 2012/0302303 | A1* | 11/2012 | Rosendo | A63F 9/0842 463/9 |
| 2019/0184275 | A1* | 6/2019 | Su | A63F 9/08 |
| 2019/0259301 | A1* | 8/2019 | Garrett | A63F 9/0842 |

FOREIGN PATENT DOCUMENTS

| | | | | |
|---|---|---|---|---|
| CN | 201969323 | | 9/2011 | |
| CN | 103394191 | A | 11/2013 | |
| CN | 203634799 | U | 6/2014 | |
| CN | 104874176 | A | 9/2015 | |
| CN | 105664482 | A | 6/2016 | |
| JP | S62502592 | | 10/1987 | |
| JP | 2009512484 | | 3/2009 | |
| WO | 8605111 | A1 | 9/1986 | |
| WO | WO-2012055103 | A1 * | 5/2012 | A63F 9/0842 |

OTHER PUBLICATIONS

First Office Action issued for Chinese Patent Application No. 201610664325.9, dated Jan. 24, 2017, 7 pages including English translation.

First Search Report issued for Chinese Patent Application No. 201610664325.9, 1 page.

Second Office Action issued for Chinese Patent Application No. 201610664325.9, dated May 3, 2017, 8 pages including English translation.

Supplementary Search Report issued for Chinese Patent Application No. 201610664325.9, 1 page.

Third Office Action issued for Chinese Patent Application No. 201610664325.9, dated Jun. 19, 2017, 8 pages including English translation.

Extended European Search Report issued for European Patent Application No. 16912518.4, dated Feb. 25, 2020, 8 pages.

Office Action issued for Japanese Patent Application No. 2019-529308, dated Feb. 4, 2020, 10 pages including English translation.

* cited by examiner

INTELLIGENT MAGIC CUBE, AND SENSING SHAFT CENTER STRUCTURE AND TIMING METHOD USED THEREBY

CROSS REFERENCE TO RELATED APPLICATIONS

This application is a continuation application based on PCT/CN2016/104810, filed Nov. 7, 2016, which claims the priority of Chinese Patent Application No. 201610664325.9, filed Aug. 12, 2016, the contents of both of which are incorporated herein by reference.

TECHNICAL FILED

The present disclosure relates to the technical field of magic cube structure, and more particularly, to an intelligent magic cube, and a sensing shaft center structure and a timing method used thereby.

BACKGROUND

Playing a magic cube is a kind of elegant body-building activity, it can train to use both hands and brain for human and is very effective in training people's movement skills. Moreover, it can enhance people's memory and spatial imagination, and it can cultivate people's endurance and perseverance. There are a number of organizations that regularly organize magic cube players to perform various competitions, such as speed twist, blind twist, and minimum step reduction, etc. However, in order to participate in these competitions, players have to go to the playing field in person, so that some players with disabilities or at a long distance may be unable to attend and be excluded.

SUMMARY

The present disclosure provides an intelligent magic cube, which can be combined with a conventional electronic product to realize real-time networking of the state data of the magic cube, so that players in different places can participate various competitions, such as speed twist, blind twist, and minimum step reduction, etc., anytime and anywhere.

A sensing shaft center structure for an intelligent magic cube includes a body. The body includes a core having an internal cavity, and a plurality of tubular shafts connected to the core. The cavity is provided with an internal central control module including a state obtaining unit. The tubular shaft is provided with a state signal sending set including a signal selector and a plurality of signal exciters. The signal selector can be paired with any one of the signal exciters, and generate a corresponding state signal, and the state obtaining unit is configured to receive a state signal sent from the state signal sending set.

The state signal received by the state obtaining unit needs further processing to obtain the data with regard to the real-time state of the magic cube required by the intelligent magic cube. The data processing may be implemented in a plurality of ways. The central control module may further include a signal sending unit, a signal receiving unit, and an output unit, the signal sending unit may be configured to send the state signal received by the state obtaining unit to a signal receiving device of a peripheral device wirelessly, the signal receiving unit may be configured to receive feedback data from a processing device of a peripheral device, and the output unit may be connected to the signal receiving unit. Alternatively, the central control module may further include a processing unit, an output unit, and an output data sending unit, the processing unit may be configured to process the state signal provided by the state obtaining unit, the output unit may be connected to the processing unit, and the output data sending unit may be configured to send the data output from the processing unit to a data receiving device of the peripheral device.

The intelligent magic cube having the above-mentioned sensing shaft center structure further includes a center block. The number of the center blocks may correspond to the number of the tubular shafts, each of the center blocks may be rotatably connected to an end of a corresponding tubular shaft, and each of the center block is fixedly connected to the signal selector or the signal exciter of a corresponding state signal sending set.

The magic cube may be a second-order magic cube, a third-order magic cube, or even an odd-order magic cube with a fifth or higher order. When it is an odd-order magic cube with a fifth or higher order, the tubular shaft is provided with a plurality of state signal sending sets. The number of the state signal sending sets on one tubular shaft is a half of a value obtained by subtracting one from the order number of the intelligent magic cube. The intelligent magic cube further includes a rotating ring rotatably connected to the tubular shaft and fixedly connected to the signal selector or the signal exciter of the corresponding state signal sending set, and the rotating ring drives a face block and a prism block on a same plane to rotate around the tubular shaft.

Furthermore, an activating device may be further included. The activating device includes an acceleration sensor or an activating button, and is connected to the central control module.

Furthermore, a display screen and/or a sounding device may be further included. The display screen and/or the sounding device are connected to the output unit.

The timing method of the above-mentioned intelligent magic cube includes: monitoring in real-time, by the central control module, a change in the state signal sent by the state signal sending set, the change being caused by rotation of the intelligent magic cube; and obtaining a real-time state of the intelligent magic cube. The timing method includes a timing activating process and a timing termination process, the timing termination process is a process in which when the central control module detects that the real-time state of the magic cube returns to an original state of the magic cube, the timing is terminated.

that the central control module monitors in real-time the change of the state signal sent by the state signal sending set caused by the rotation of the intelligent magic cube, thereby obtaining the real-time state of the intelligent magic cube, and further includes a timing activating process and a timing termination process, wherein for the timing termination process, when the central control module detects that the real-time state of the magic cube returns to the original state of the magic cube, the timing may be terminated. When the intelligent magic cube has an activating device, the timing activating process may be activated by sensing an acceleration change of the intelligent magic cube, or by a button signal.

Due to using the novel sensing shaft center structure, the intelligent magic cube disclosed in the present disclosure has the ability to obtain the real-time state of the magic cube, so that the online magic cube competition can be realized. Furthermore, since the ability to obtain the real-time state of magic cube is not realized by the way of image capture, the technical complexity and equipment complexity are very low, and it is easy to be popularized, thereby changing the traditional play mode of the magic cube.

BRIEF DESCRIPTION OF THE DRAWING

In order to more clearly illustrate the technical solutions in the embodiments of the present disclosure, the drawings used in the description of the embodiments will be briefly described below. It is apparent that the described drawings are only a part of the embodiments of the present disclosure, and not all of the embodiments, and those skilled in the art can obtain other designs and drawings according to the drawings without any creative work.

DETAILED DESCRIPTION

The concept, the specific structure and the technical effects of the present disclosure will be clearly and completely described in conjunction with the embodiments and the accompanying drawings in order to fully understand the objects, features and effects of the present disclosure. It is apparent that the described embodiments are only a part of the embodiments of the present disclosure, and not all of the embodiments, and other embodiments obtained by those skilled in the art based on the embodiments of the present disclosure without creative efforts fall within the protection scope of the present disclosure. In addition, all the coupling/connecting relationships mentioned herein do not refer to the members directly connected to each other, but refer to a better coupling structure that can be constituted by adding or reducing coupling accessories according to the specific implementation. The various technical features in the present disclosure can be combined with each other without conflicts.

Figure 1:
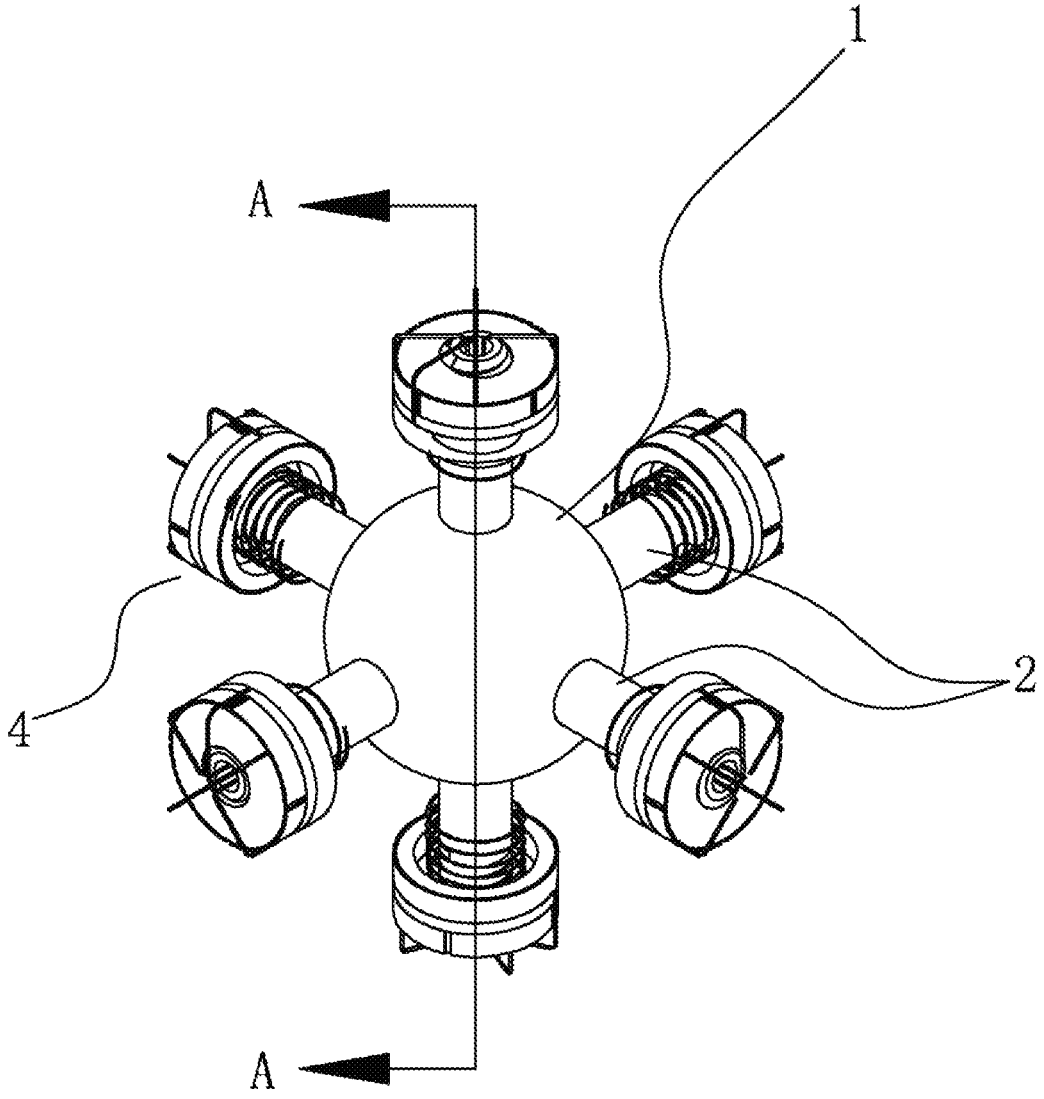
FIG. 1 is a perspective diagram illustrating a sensing shaft center structure used in the intelligent magic cube.
Figure 2:
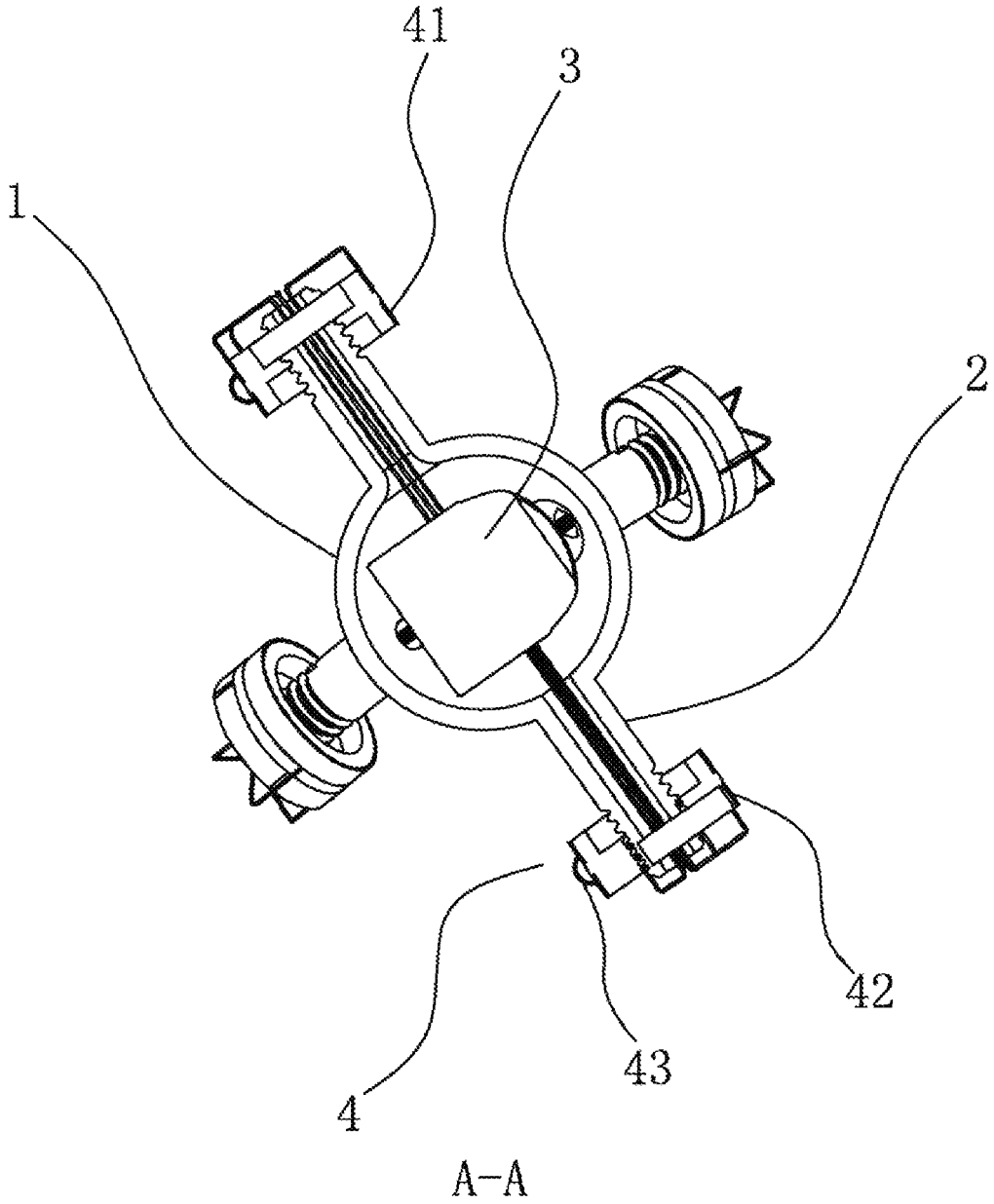
FIG. 2 is a full cross-sectional diagram taken along line A-A of FIG. 1.

As shown in FIG. 1 and FIG. 2, a sensing shaft center structure for an intelligent magic cube includes a body. The body includes a core 1 having an internal cavity, and a plurality of tubular shafts 2 connected to the core 1. The cavity is provided with an internal central control module 3 including a state obtaining unit. The tubular shaft 2 is provided with a state signal sending set 4 including a signal selector and a plurality of signal exciters. The signal selector can be paired with any one of the signal exciter, and generate a corresponding state signal, and the state obtaining unit is configured to receive a state signal sent from the state signal sending set 4. The state signal sending set 4 includes an annular contact piece 41, an arc contact piece 42, and a brush 43. The annular contact piece 41 is arranged around the outer wall of the tubular shaft 2. A plurality of arc contact pieces 42 are located on an annular ring arranged in parallel with the annular contact piece 41. The annular contact piece 41 and each arc contact piece 42 are respectively connected to the state obtaining unit. The brush 43 can touch the annular contact piece 41 and any one of the arc contact pieces 42 at the same time, and the state obtaining unit is configured to receive the state signals of the annular contact piece 41 and any one of the arc contact piece 42.

Figure 3:
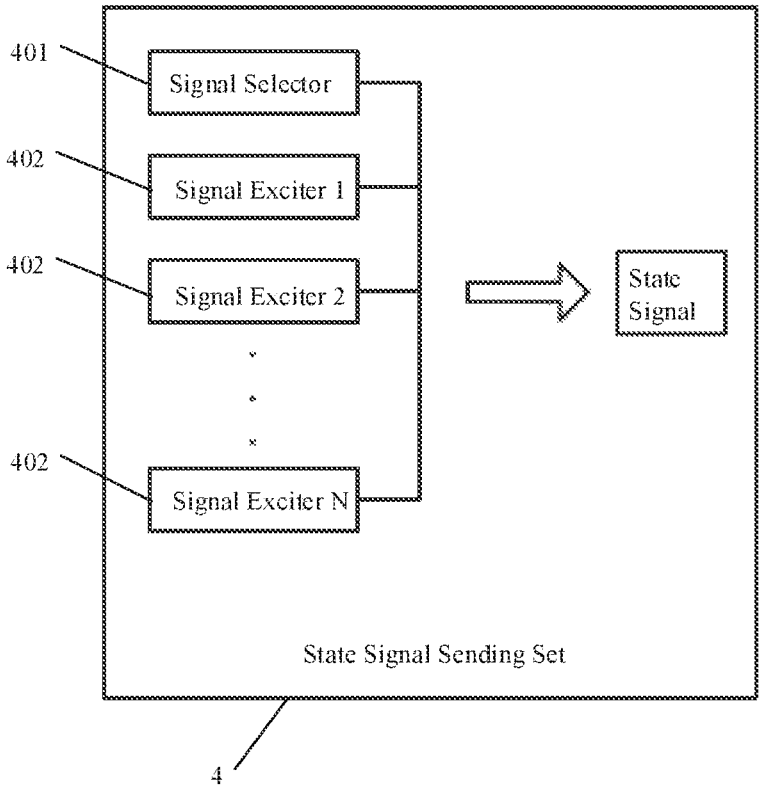
FIG. 3 is an exemplary block diagram illustrating the structure of the state signal sending set in one embodiment of the present disclosure.
Figure 4:
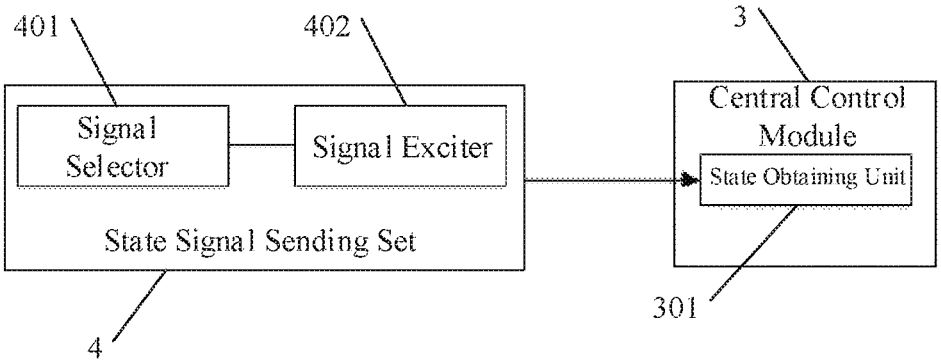
FIG. 4 is an exemplary schematic diagram of information transfer between the state signal sending set and the central control module in one embodiment of the present disclosure.

In one embodiment, as shown in FIG. 3, the state signal sending set 4 includes a signal selector 401 and at least one signal exciter 402. The state signal sending set 4 may generate a corresponding state signal. In the embodiment, as shown in FIG. 4, the central control module 3 includes a state obtaining unit 301 that receives the state signal sent from the state signal sending set 4. Furthermore, as a preferred embodiment, the central control module 3 further includes a signal sending unit, a signal receiving unit, and an output unit. The signal sending unit is configured to send the state signal received by the state obtaining unit to a signal receiving device of a peripheral device wirelessly. The signal receiving unit is configured to receive feedback data from a processing device of the peripheral device. The output unit is connected to the signal receiving unit. In this embodiment, the state signal received by the state obtaining unit is wirelessly sent to the signal receiving device of the peripheral device, and compiled and processed by an external processor. And then obtained data is sent back to the signal receiving unit, and fed back to the player via the output unit.

Figure 5:
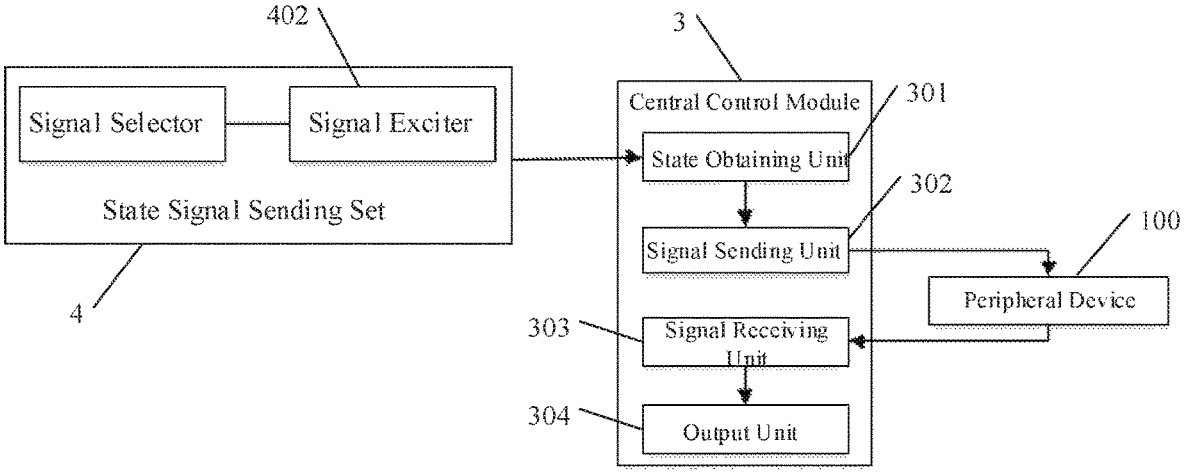
FIG. 5 is an exemplary schematic diagram of information transfer among a state signal sending set, a central control module, and the signal receiving unit of the peripheral device in one embodiment of the present disclosure.

In one embodiment, as shown in FIG. 5, the central control module 3 includes a signal sending unit 302, a signal receiving unit 303 and a output unit 304. The signal sending unit 302 is configured to wirelessly send the state signal received by the state obtaining unit 301 to the signal receiving device of the peripheral device 100. The signal receiving unit 303 is configured to receive feedback data sent from a signal processing device of the peripheral device 100. The output unit 304 is connected to the signal receiving unit 303. Furthermore, as a preferred embodiment, the central control module 3 further includes a processing unit and an output unit. The processing unit is configured to process the state signal provided by the state obtaining unit, and the output unit is connected to the processing unit. In this embodiment, the state signal is directly processed and converted in the central control module 3, and then fed back to the player via the output unit. Furthermore, the central control module 3 further includes an output data sending unit configured to send the data output from the processing unit to the data receiving device of the peripheral device.

Figure 6:
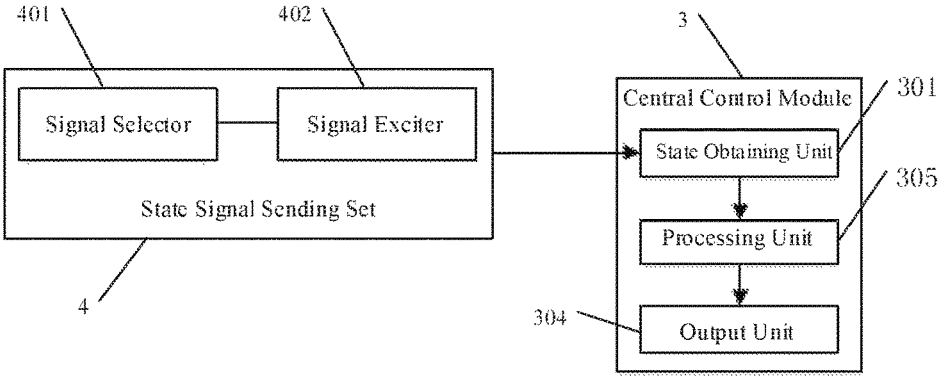
FIG. 6 is an exemplary schematic diagram of information transfer between the state signal sending set and the central control module in another embodiment of the present disclosure.

In one embodiment, as shown in FIG. 6, the central control module 3 includes a processing unit 305 and an output unit 304. The processing unit 305 is configured to process the state signal provided by the state obtaining unit 301 The output unit 304 is connected to the processing unit 305. An intelligent magic cube includes a shaft center and center blocks. The shaft center may be a sensing shaft center structure. The number of the center blocks may correspond to the number of the tubular shafts 2. Each of the center blocks may be rotatably connected to an end of a corresponding tubular shaft 2. Each of the center blocks is fixedly connected to the signal selector or the signal exciter of a corresponding state signal sending set 4. The intelligent magic cube further includes an activating device including an acceleration sensor or a activating button, and connected to the central control module.

Figure 7:
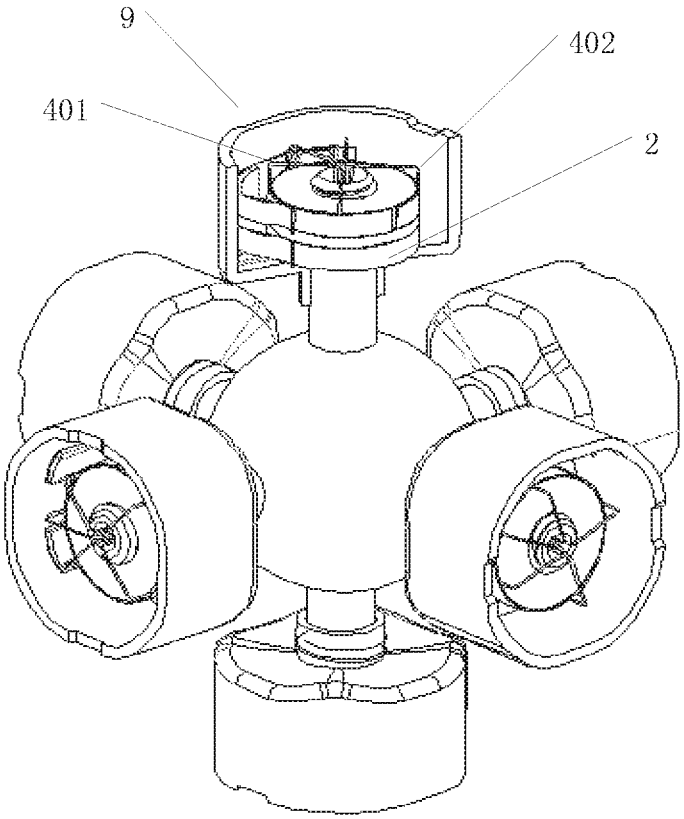
FIG. 7 is a partial cross-sectional diagram illustrating the center block rotatably connected to the distal end of the tubular shaft and fixedly connected to the signal selector in one embodiment of the present disclosure.

In one embodiment, as shown in FIG. 7, a center block 9 is rotatably connected to a distal end of the tubular shaft 2 and fixedly connected to the signal selector 401.

Embodiment 1

Figure 8:
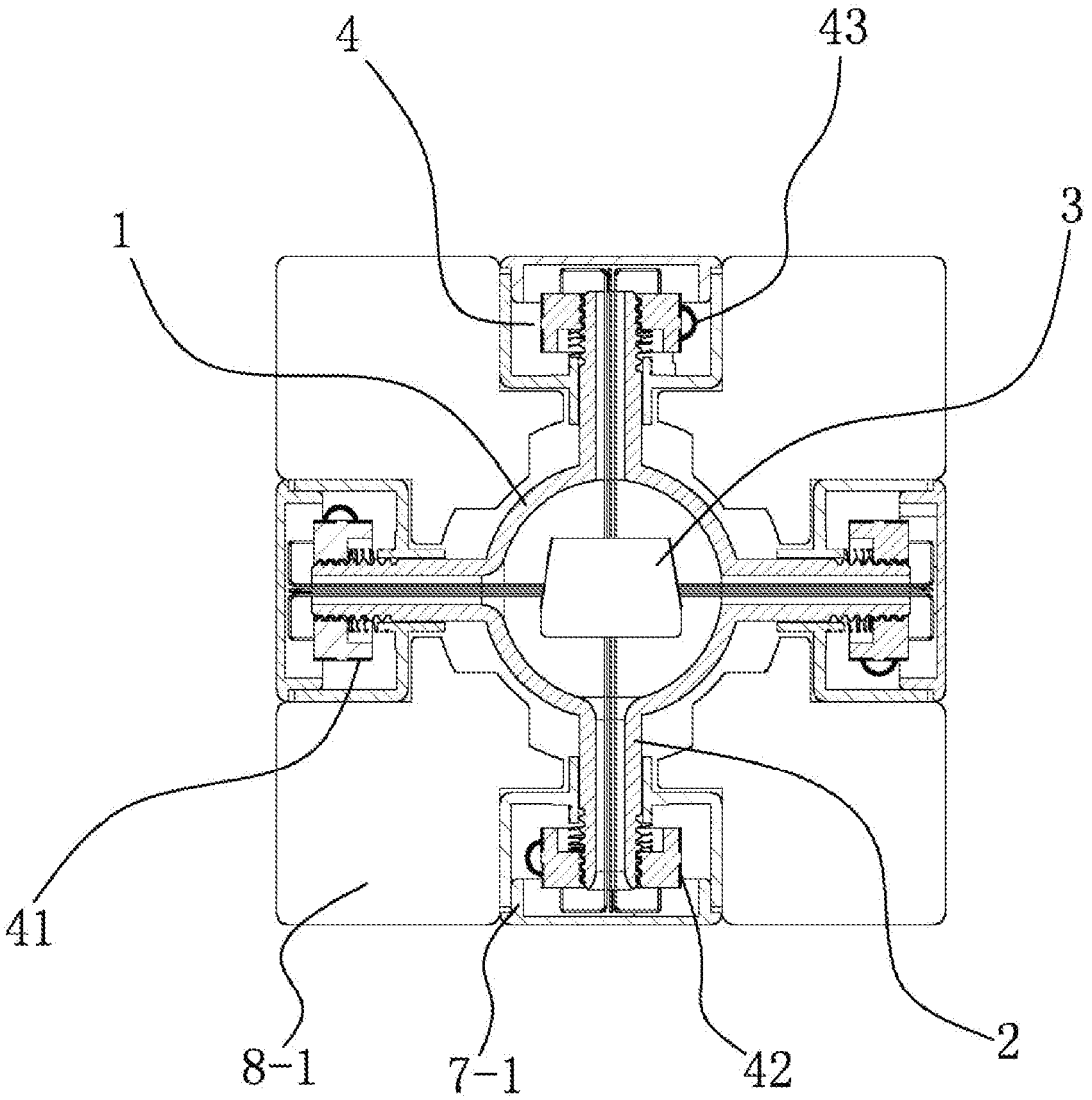
FIG. 8 is a full cross-sectional diagram of Embodiment 1.

As shown in FIG. 8, a third-order intelligent magic cube includes a sensing shaft center structure, a center block 7-1, a prism block 8-1, and a corner block. The contact piece set on the tubular shaft 2 includes one annular contact piece 41 and four arc contact pieces 42 corresponding to four planes of the magic cube parallel to the tubular shaft 2 respectively. The brush 43 is fixedly connected to the center block 7-1. When the plane where the center block 7-1 is located is rotated, the position of the brush 43 is changed, so that the connection relationship between the annular contact piece 41 and the arc contact piece 42 is changed. The state signal is recorded by the state obtaining unit, and the state signal is converted into the real-time state of the third-order intelligent magic cube by the processing unit in the central control module 3.

Embodiment 2

Figure 9:
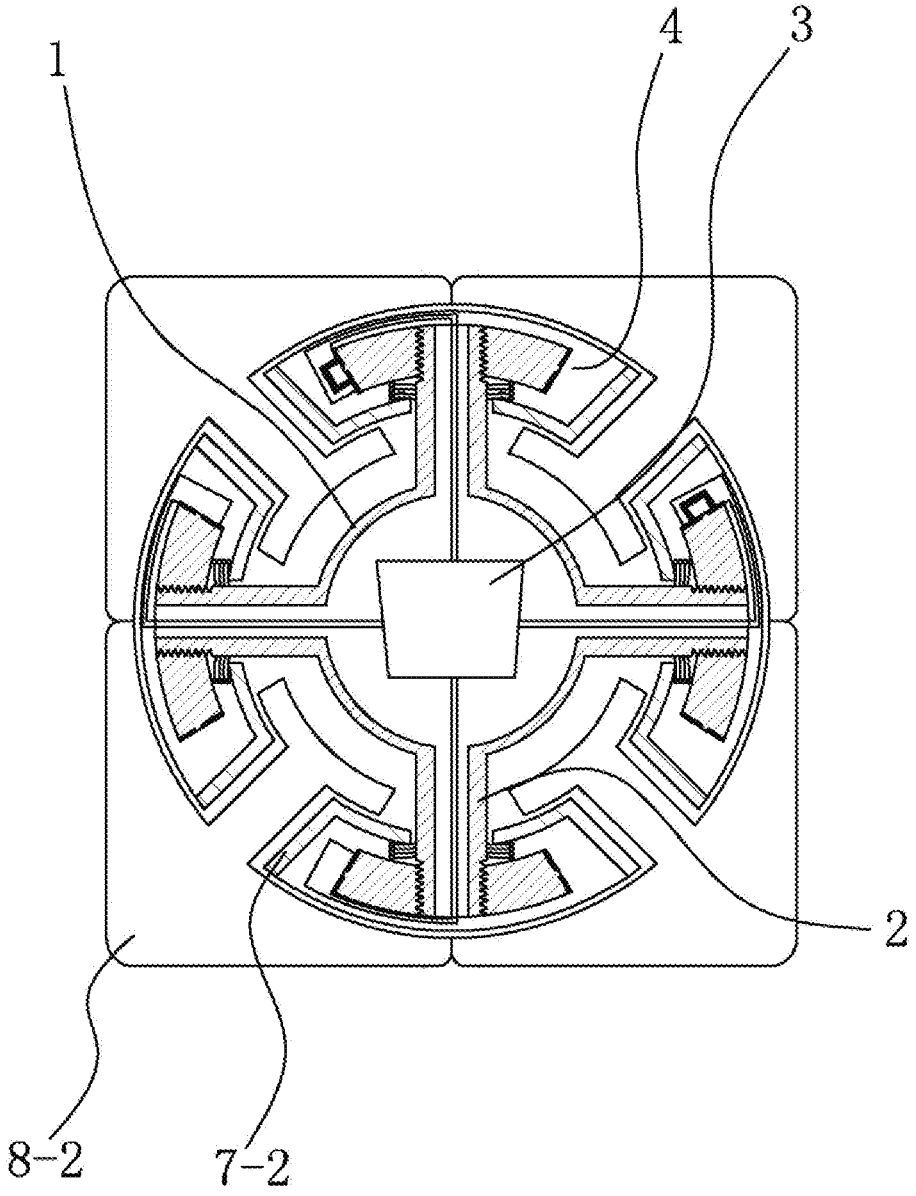
FIG. 9 is a full cross-sectional diagram of Embodiment 2.

As shown in FIG. 9 a second-order intelligent magic cube includes a sensing shaft center structure, a center block 7-2, and a prism block 8-2. The contact piece set on the tubular shaft 2 includes one annular contact piece 41 and four arc contact pieces 42 corresponding to four planes of the magic cube parallel to the tubular shaft 2 respectively. The brush 43 is fixedly connected to the center block 7-2. When the plane where the center block 7-2 is located is rotated, the position of the brush 43 is changed, so that the connection relationship between the annular contact piece 41 and the arc contact piece 42 is changed. The state obtaining unit records the state signal, and sends the state signal to a personal computer or a handheld electronic equipment of a player by the signal sending unit in the central control module 3. The state signal may be converted to obtain the real-time state of the second-order intelligent magic cube.

Embodiment 3

Figure 10:
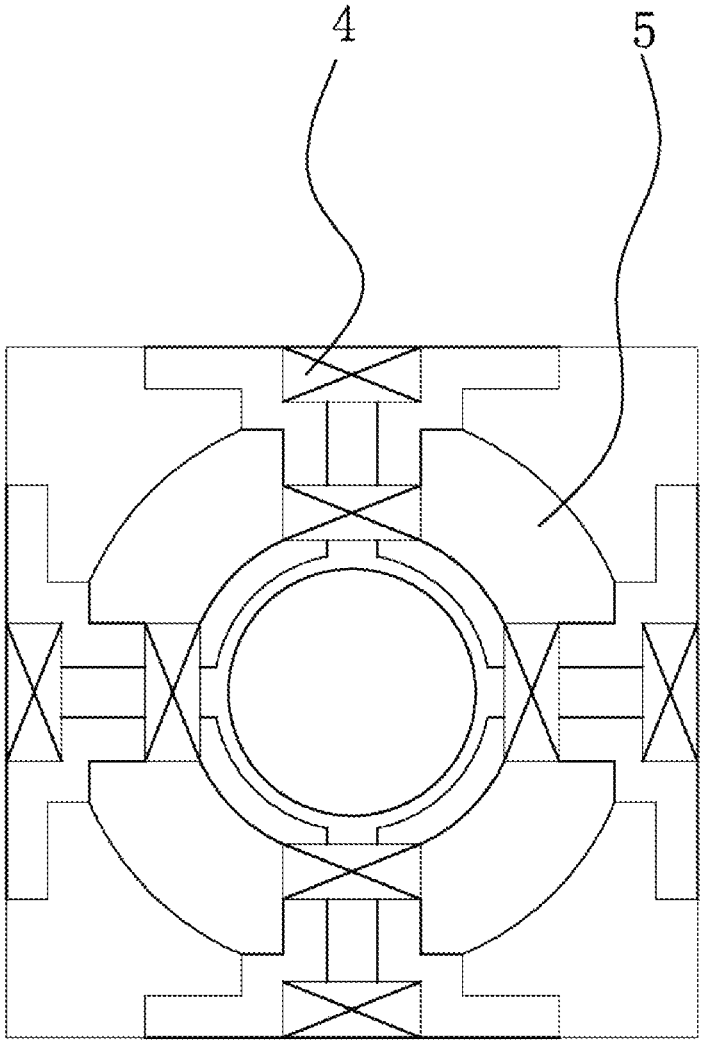
FIG. 10 is a schematic structural diagram of Embodiment 3.

As shown in FIG. 10, the fifth-order intelligent magic cube includes a sensing shaft center structure, a center block 7-2 and a rotating ring 5. The tubular shaft 2 is provided with a plurality of state signal sending sets 4, and one tubular shaft 2 is provided with two state signal sending sets 4. The rotating ring 5 is rotatably connected to the tubular shaft 2 and fixedly connected to the signal selector or the signal exciter of the corresponding state signal sending set 4. The rotating ring 5 drives the face block and the prism block on the same plane to rotate around the tubular shaft 2.

Furthermore, as a preferred embodiment, the fifth-order intelligent magic cube includes a display screen and/or a sounding device connected to the output unit. The display screen can show information such as the game time, and the sounding device such as a buzzer can prompt a start time or an end time.

Embodiment 4

Figure 11:
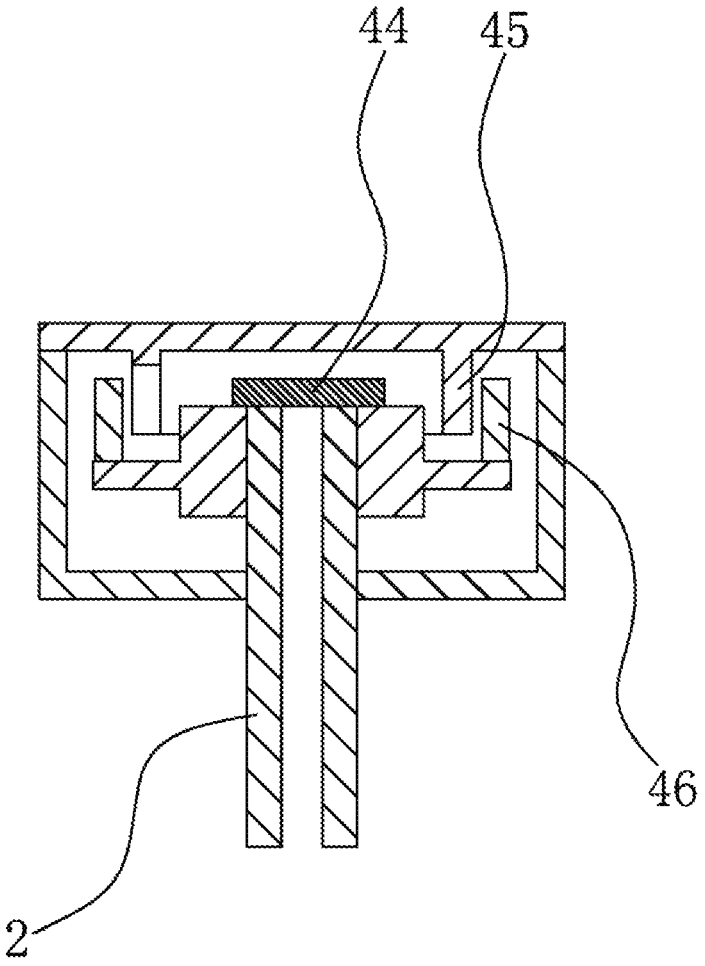
FIG. 11 is a schematic diagram of Embodiment 4.

The state signal sending set 4 may also be implemented in a form of photoelectric induction. As shown in FIG. 11, the state signal sending set 4 includes a light source 44, a blocking plate 45, and a plurality of light receivers 46. The blocking plate 45 is fixedly connected to the center block, and the blocking plate 45 is provided with a gap. When the gap is aligned with the light receiver 46, the light receiver 46 can receive light from the light source 44 and send the state signal.

Embodiment 5

Figure 12:
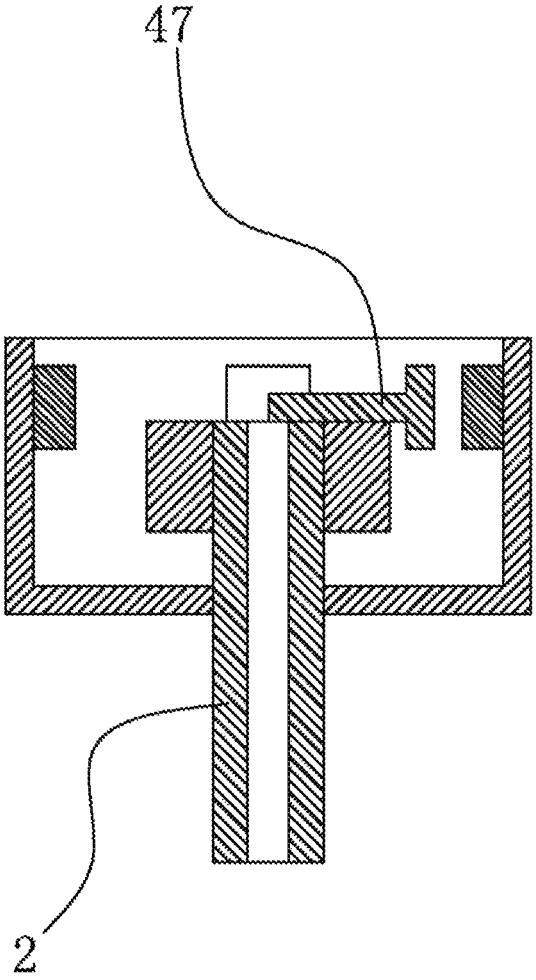
FIG. 12 is a schematic diagram of Embodiment 5.

The state signal sending set 4 may also be implemented in a form of electromagnetic induction. As shown in FIG. 12, the state signal sending set 4 includes a Hall sensor 47 and a plurality of magnets. The magnetic field strengths of the magnets are different from each other. The Hall sensor 47 is fixedly connected to the center block. When the center block rotates, the Hall sensor 47 generates different voltages during passing the different magnets, thereby identifying the direction of rotation and sending the state signal.

The timing method of the above-mentioned intelligent magic cube includes: monitoring in real-time, by the central control module, a change in the state signal caused by rotation of the intelligent magic cube; and obtaining a real-time state of the intelligent magic cube. The timing method includes a timing activating process and a timing termination process, and the timing termination process is a process in which when the central control module detects that the real-time state of the magic cube returns to an original state of the magic cube, the timing is terminated.

Furthermore, as a preferred embodiment, the intelligent magic cube includes an activating device including an acceleration sensor or an activating button connected to the central control module. The timing activating process is activated by sensing the acceleration change, or by pressing a button.

Figure 13:
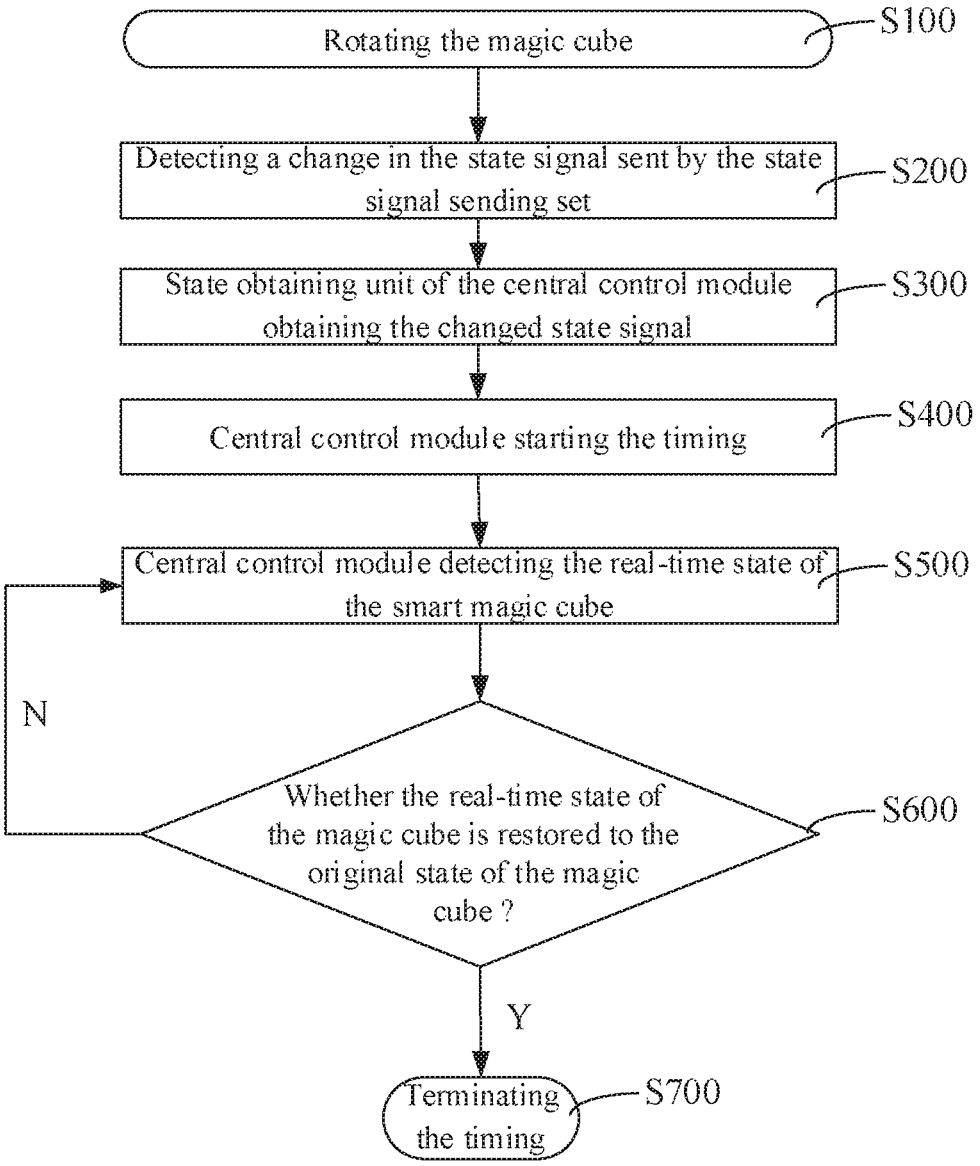
FIG. 13 is an exemplary flowchart illustrating the timing method for the smart magic cube in one embodiment of the present disclosure.

In one embodiment, as shown in FIG. 13, the timing method of the smart magic cube includes the following steps: Step S100, rotating the magic cube; Step S200, detecting a change in the state signal sent by the state signal sending set; Step S300, the state obtaining unit of the central control module obtaining the changed state signal; Step S400, the central control module starting the timing; Step 5500, the central control module detecting the real-time state of the smart magic cube; Step S600, the central control module detecting that the real-time state of the magic cube is restored to the original state of the magic cube; Step S700, the central control module terminating the timing.

The preferred embodiments of the present disclosure have been described above, but the disclosure is not limited to the described embodiments, and those skilled in the art may make various equivalents or substitutions without departing from the spirit of the disclosure, these equivalent variations or substitutions are included within the scope of the claims of this application.

What is claimed is:

1. A sensing shaft center structure for an intelligent magic cube, comprising:

a core having an internal cavity; and a plurality of tubular shafts connected to the core, wherein the cavity is provided with an internal central control module comprising a state obtaining unit, wherein each of the tubular shafts is provided with at least one state signal sending set comprising a signal selector and at least two signal exciters, and wherein the signal selector is pairable with any one of the signal exciters to generate a corresponding state signal, and the state obtaining unit is configured to receive a state signal sent from the state signal sending set, wherein the central control module further comprises a signal sending unit configured to send the state signal received by the state obtaining unit to a signal receiving device of a peripheral device wirelessly.

2. The sensing shaft center structure of claim 1, wherein the central control module further comprises:

a signal receiving unit configured to receive feedback data from a processing device of the peripheral device; and an first output unit connected to the signal receiving unit.

3. The sensing shaft center structure claim 2, wherein the central control module further comprises:

a processing unit configured to process the state signal provided by the state obtaining unit; and an second output unit connected to the processing unit.

4. An intelligent magic cube, comprising a sensing shaft center structure of claim 1, and center blocks, wherein the number of the center blocks corresponds to the number of the tubular shafts, each of the center blocks is rotatably connected to an end of a corresponding tubular shaft, and each of the center blocks is fixedly connected to the signal selector or the signal exciter of a corresponding state signal sending set.

5. A timing method used in the intelligent magic cube of claim 4, comprising:

rotating the magic cube;

detecting a change in the state signal sent by the state signal sending set;

obtaining, by the state obtaining unit of the central control module, the changed state signal;

starting timing by the central control module;

detecting, by the central control module, a real-time state of the magic cube;

detecting, by the central control module, that the real-time state of the magic cube is restored to an original state of the magic cube; and terminating the timing by the central control module.

6. An intelligent magic cube, comprising:

a sensing shaft center structure for an intelligent magic cube, comprising:

a core having an internal cavity; and a plurality of tubular shafts connected to the core, wherein the cavity is provided with an internal central control module comprising a state obtaining unit, wherein each of the tubular shafts is provided with at least one state signal sending set comprising a signal selector and at least two signal exciters, and wherein the signal selector is pairable with any one of the signal exciters to generate a corresponding state signal, and the state obtaining unit is configured to receive a state signal sent from the state signal sending set; and center blocks, wherein the number of the center blocks corresponds to the number of the tubular shafts, each of the center blocks is rotatably connected to an end of a corresponding tubular shaft, and each of the center blocks is fixedly connected to the signal selector or the signal exciter of a corresponding state signal sending set, wherein the intelligent magic cube is an odd-order magic cube with a fifth or higher order, and the number of the state signal sending sets on each tubular shaft is a half of a value obtained by subtracting one from the order number of the intelligent magic cube.

7. The intelligent magic cube of claim 6, wherein the intelligent magic cube further comprises a rotating ring rotatably connected to the tubular shaft and fixedly connected to the signal selector or the signal exciter of a corresponding state signal sending set, and the rotating ring drives a face block and a prism block on a same plane to rotate around the tubular shaft.

8. The intelligent magic cube of claim 6, further comprising an activating device comprising an acceleration sensor, wherein the activating device is connected to the central control module.

* * * * *